US006247450B1

(12) United States Patent
Jiang

(10) Patent No.: US 6,247,450 B1
(45) Date of Patent: Jun. 19, 2001

(54) ELECTRONIC CONTROLLED DIESEL FUEL INJECTION SYSTEM

(75) Inventor: He Jiang, Canton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/472,284

(22) Filed: Dec. 27, 1999

(51) Int. Cl.[7] ..... F02M 37/04; F02M 7/00
(52) U.S. Cl. ..... 123/446; 123/496
(58) Field of Search ..... 123/446, 506, 123/496–7, 500–1

(56) References Cited

U.S. PATENT DOCUMENTS

| | | | | |
|---|---|---|---|---|
| 4,503,825 | * | 3/1985 | Schneider | 123/501 |
| 4,505,243 | * | 3/1985 | Miwa | 123/446 |
| 4,622,942 | * | 11/1986 | Nozaki et al. | 123/446 |
| 4,811,715 | * | 3/1989 | Djordjevic et al. | 123/447 |
| 5,072,709 | * | 12/1991 | Long et al. | 123/446 |
| 5,443,047 | * | 8/1995 | Ishiwata et al. | 123/446 |
| 5,551,398 | * | 9/1996 | Gibson et al. | 123/446 |
| 5,558,067 | * | 9/1996 | Blizard et al. | 123/501 |
| 5,628,293 | * | 5/1997 | Gibson et al. | 123/506 |
| 6,019,091 | * | 2/2000 | Spoolstra | 123/496 |

* cited by examiner

*Primary Examiner*—Thomas N. Moulis

(74) *Attorney, Agent, or Firm*—Bill C. Panagos

(57) ABSTRACT

A fuel injection system, comprising a low pressure fuel delivery pump with constant output in fluid communication with a low pressure fuel line; said fuel line connected to an electronic controlled fuel pressure regulator and fuel pressure sensor;

an electronic control module to monitor and adjust fuel pressure in said low pressure fuel line to a desired fuel delivery pressure and supply fuel to an injector at a feed-back controlled pressure; and at least one injector in fluid communication with a cylinder in an internal combustion engine; said injector having an injector body equipped with a fuel metering orifice to supply fuel from the fuel line to a fuel cumulative chamber within the injector, a reciprocating plunger within said injector; said plunger equipped with a plunger; said plunger passage opening at one end to said fuel cumulative chamber, and, upon reciprocation of the plunger within the injector, opening at its other end to said metering orifice; said injector further equipped with an electronically controlled solenoid control valve to operate a fuel needle within said injector to inflict fuel into said engine cylinder; and a camshaft at least one cam lobe to drive said injector plungers; said cam lobe having a base circle section to meter fuel for injection; a rising section for pressurizing fuel in the cumulative chamber; a zero velocity section of sufficient length to accommodate a variety of fuel injection timing sequences, and a falling section; said camshaft interactive with a rocker arm to drive said plunger and inject fuel into said engine cylinder.

7 Claims, 3 Drawing Sheets

70
20
23
25
22
18
10
21
27
72
80
84
24
16
68
12
78
26
S
13
76
86
28
74
14
30
42
44
38
36
ECM
35
47
34
81
40

ELECTRONIC CONTROLLED DIESEL FUEL INJECTION SYSTEM

BACKGROUND OF THE INVENTION

1. Field of Invention

The present invention relates to a new fuel injector and fuel injection system for internal combustion engines and particularly for heavy-duty diesel cycle internal combustion engines. The present invention further relates to a fuel injector and fuel injection system which takes advantage of both electronic unit injectors and common rail fuel systems to improve power consumption for the fuel system in reference to drive of a camshaft train.

The present invention further relates to a fuel injection system and a fuel injector which provides high injection pressure characteristic of electronic unit injectors and flexibility of adjusting injection pressure in a common rail system.

The present invention further relates to a new, heavy duty diesel fuel injection system which take advantage of Electronic Unit Injectors (EUI) system, while improving EUI's flexibility to define injection timing and the ability to adjust injection pressure independent of the engine speed or load. In addition, the present invention improves power consumption for the fuel system and improves the roughness of the drive camshaft train.

2. Description of the Related Art

The present invention is related to a electronically controlled fuel injection system and a fuel injector which is capable of being driven from a camshaft train.

Deckard et al., U.S. Pat. No. 4,572,433 discloses an electromagnetic unit fuel injector for use in a multi-cylinder, diesel engine having an externally actuated pump for intensifying the pressure of fuel delivered to the pressure actuated injection valve controlling a flow discharge out through a spray outlet which is normally biased to a closed position by a spring. Pressurized fuel from the pump is supplied via a throttling orifice to a modulated pressure servo-controlled chamber having a servo piston means operatively associated with the injection valve. A drain passage extends from the servo control chamber with flow therethrough controlled by a solenoid actuated control valve in the form of a pop-it valve, which is normally biased to a closed position by a valve return spring of a predetermined force whereby the control valve is also operative as a pressure relief valve and preferably, a secondary pressure relief valve means is also incorporated into the unit injector so that all of the unit injectors for the engine will operate at a uniform maximum peak pressure.

Although Deckard '433 substantially achieves this goal, it has been observed that there are still variations in maximum peak pressure achievable in a fuel system and particularly between individual fuel injection units on an internal combustion engine. This variability in pressure can affect the performance of the engine and reduce the efficiency of the engine during operation.

Gibson et al., U.S. Pat. No. 5,535,723 discloses an electronically controlled fluid injector having pre-injection pressurizable fluid storage chamber in an outwardly opening direct operated check. The Gibson concept is directed to an improved electronically-controlled fuel injection system which comprises a fluid storage chamber in a direct operated check. Pressurization of the fluid in the storage chamber begins before the start of the fluid injection. Fluid injection begins by hydraulically unbalancing the check. Fluid injection sharply ends by hydraulically balancing the check to allow a biasing device to close the check. Fluids such as fuel can be injected as a purely vapor phase to improve mixing and combustion air. The system of Gibson et al controls several fluid injection parameters including higher peak fluid injection capability and less fluid injection pressure drop at the end of injection, thereby resulting in improved engine performance and lower noise, emissions, and wear.

Gibson et al achieves these purposes in part by use of a solenoid means which activates two valves for pressurizing the fuel prior to the injection. The first valve is movable between a first position, which opens fluid communication between the storage chamber and control passage and the second position to close fuel communication. The second valve is a three-way valve such as a pop-it valve or a spool valve which at its first position blocks fluid communication between a pressure control chamber and the control passage and opens fluid communication between the pressure control chamber and the injection chamber.

It has been determined that a simpler and more advanced system is necessary in order to address all the concerns in the fuel injection art. To this end, it's necessary to control the pressure of the fuel from the fuel source all the way through to the injection event. All of these things can be achieved by use of a simple injection mechanism such as disclosed in this application whereby the fuel system is controlled directly from the Engine Control Module ("ECM") to ensure uniform pressure throughout and maximum results at all engine speeds.

The present invention is directed to overcoming one or more of the shortcomings as set forth above.

SUMMARY OF THE INVENTION

The present invention is a new, electronic controlled fuel injection system as well as an Electronic Unit Injector (EUI) for use in the same. The fuel injection system of the instant invention is designed for use in internal combustion engines and particularly heavy-duty diesel fuel injection systems and takes advantage of both Electronic Unit Injection ("EUI") and common rail fuel systems. To this end, the high injection pressure of EUI's is combined with the flexibility of adjusting injection pressure in common rail systems. The design of the instant invention improves power consumption for the fuel system, as well as provides the roughness of the system to be driven by a camshaft train.

The system components are comprised of a fuel delivery pump which is preferably a low pressure pump so that output pressure is kept at a constant 10 bar through the relatively low pressure fuel line. The relatively low pressure fuel line is connected to an electronic controlled pressure regulator and pressure sensor. Fuel pressure is feedback adjusted by an electronic control module (ECM) to monitor fuel pressure in the common fuel delivery line and to adjust the pressure regulator to achieve a desired specific fuel delivery pressure accurately. The common fuel delivery line feeds diesel fuel to all injectors at a feed-back controlled pressure. A slow response solenoid with a Pulse Width Modulated (PMW) drive is used to operate the regulator, since the pressure in the common fuel delivery line may not vary rapidly.

Each cylinder in an internal combustion engine is equipped with an electronic unit injector. This electronic unit injector consists of an injector body with a metering orifice in accumulative chamber, a plunger with a returning spring, a solenoid control valve with a spring, and nozzle needle with spring. The fuel injection timing is controlled by the ECM through activation and deactivation of a solenoid control valve.

A metering orifice is precisely machined to provide a flow passage at the plunger bushing wall or in the plunger of the EUI. The amount of fuel being fed in the a cumulative chamber through the metering orifice will be determined by the fuel pressure on the common delivery line and the size of the metering orifice. The volume of the a cumulative chamber is 20 to 60 times the maximum fuel volume/cycle, and is optimized based upon a tradeoff between injector compactness, maximum injection pressure and maximum injector pressure drop.

The system further includes a camshaft with a plurality of specially designed cam lobe to drive the injector plungers. The cam has four sections. The first is a base circle section for fuel metering process. The second is a rising section for pressurizing fuel captured in the accumulative chamber. The third is a zero velocity section when a plunger reaches its maximum lift. The third section should be long enough to cover all possible injection timing sequences. The fourth section is a falling section which should be overlapped with a rising section of another cam lobe for recovering energy of remaining pressurized fuel in the accumulative chamber.

DETAILED DESCRIPTION OF THE PREFERRED EMBODIMENT

Figure 1:
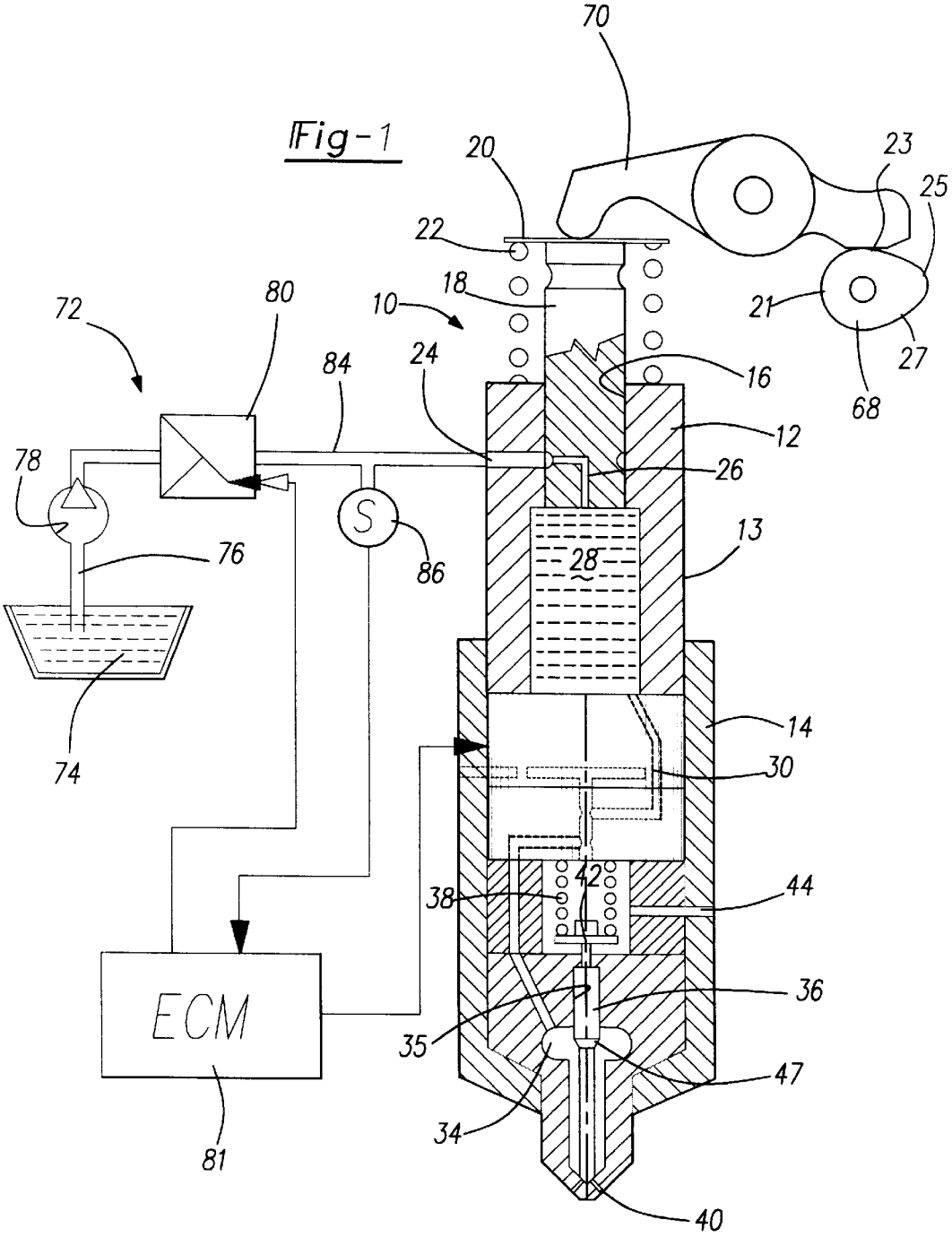
FIG. 1 is a schematic cross sectional view of the an Electronic Unit Injector (EUI) and an Electronic Controlled Fuel Injection System.

Turning now to the drawings wherein like numerals refer to like structures, and particularly to FIG. 1, there is depicted there in a schematic, cross-sectional view of the Electronic Controlled Fuel Injection System of the instant invention.

Injector 10 is comprised of a threaded body 12 and a threaded nut 14 wherein nut 14 is cooperatively threaded to threaded body 12 in final assembly to form housing 13 of the fuel injector of the Electronic Controlled Fuel Injector. Threaded body 12 has a bore 16 extending substantially therethrough which slidingly accommodates plunger 18. Plunger 18 is actuated in the conventional manner by plunger actuator follower 20 and biasing return spring 22. Threaded body 12 is equipped with a fuel metering orifice 24 oriented such that when the plunger is in a fully returned position, a low pressure fuel passage 26 is provided in the plunger which cooperatively engages the metering orifice to allow fuel to pass from the variable fuel line 84 to the fuel accumulation volume chamber 28. It is important to note that metering orifice 24 is of a larger diameter than the low pressure fuel passage 26.

Figure 2:
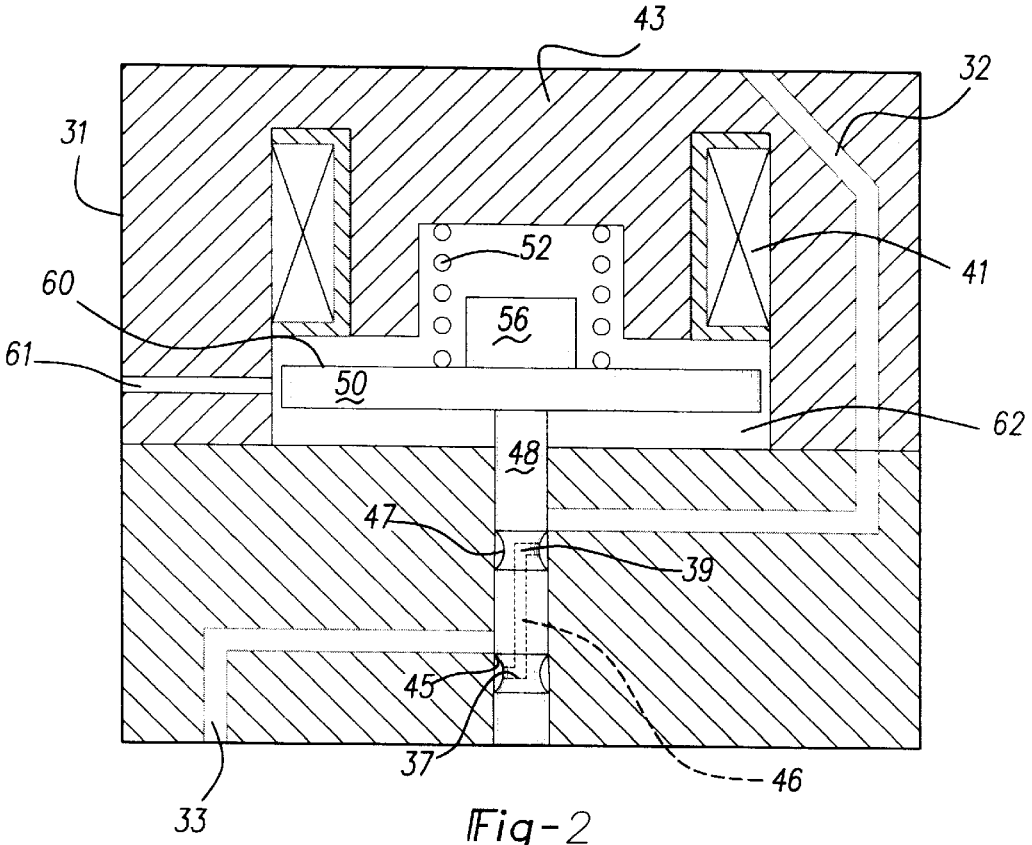
FIG. 2 is a cross-sectional view of the slow response solenoid adapted for use in the fuel injector for the electronically controlled fuel injection system.

Nut 14 is bored to accommodate a solenoid control valve assembly 30 which is oriented proximal to the fuel accumulation volume chamber 28. Turning to FIG. 2, the solenoid control valve assembly 30 is preferably of a slow response variety and may be driven by a pulse width modulation output from an engine control module (ECM) not shown.

The solenoid 31 includes a stator 43 with an electric coil 41 wound thereon and the coil is controllably connected to a source of electric energy and the ECM so that control of the electric solenoid can be electronically controlled. The electronic solenoid armature 50 is movably mounted within the solenoid assembly and is magnetically proximate to the stator core. The armature is resiliently biased away from the core by an armature coil spring 52. Moreover, the armature includes a stop 56 to prevent damage to the armature during activation and deactivation. The armature is in reality a solenoid poppet valve 46 having a dual valve stem 48 attached to the armature spring seat 60. The dual valve stem has valves 47 and 45 in spaced relationship to each other along the valve stem. The armature spring seat is movable within armature chamber 62 so that by energizing the coil 41, the armature is magnetically actuated within the chamber a predetermined distance. Passage 61 is provided to ensure that armature chamber 62 is vented so that it is always of a lower pressure than the fuel in the fuel line.

It is expected that a slow response solenoid could be used since the supply pressure is not varied rapidly through the fuel system. Pressure at the injection point are at optimum ranges independent of engine speed. This allows improved control of fuel injection parameters, including higher peak injection capability and less fluid injection pressure drop at the end of injection resulting in improved engine performance and lower emissions, noise and wear. Moreover, it is possible using the fuel injection system of the instant invention to design a common rail fuel system which does not suffer from pressure variability and resulting injection inefficiencies.

Figure 3:
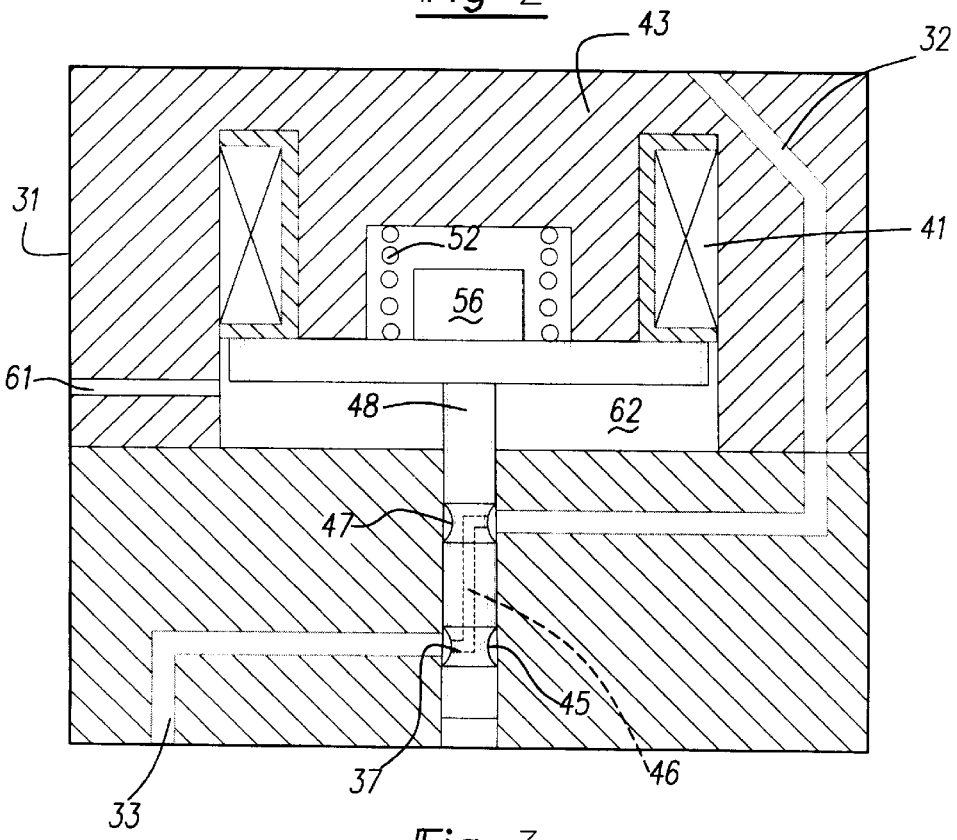
FIG. 3 is a cross-sectional view of the slow response solenoid of FIG. 2 in its activated position.

As can be seen in FIGS. 1, 2, and 3, high pressure fuel passage 32 extends through the stator of the solenoid and is in fluid communication with the fluid accumulation volume chamber 28 in the body of the injector. The dual control valve stem 48 is equipped with a Z-shaped fuel bypass passage 46 that has the first opening 39 at valve 47 and a second opening 37 at valve 45 which allows fluid communication between high pressure fuel passage 32 and high pressure fuel passage 33. The high pressure fuel passage 33 is put in fluid communication with high pressure fuel passage 32 when the solenoid valve is actuated as seen in FIG. 3, thereby moving the fuel passage 46 into communication with both fuel passage 33 and fuel passage 32 to allow pressurized fuel to travel from the fuel accumulation pressure chamber 28 through the solenoid control valve assembly and into the spray tip chamber 34. The tip of the injector is of the conventional sort, having a spray tip valve 36 with a spring seat 42 slidably disposed within a bore 35 in the tip. The spray tip coil spring 38 acts to bias the spray tip valve assembly in a closed position so that fuel does not exit through orifices 40 Passage 44 is provided as a vent to ensure armature chamber 11 is a low pressure chamber relative to the incoming fuel.

The spray tip needle is equipped with a differential portion which in reaction to pressurized fuel entering chamber 34, biases against the spring thereby opening the spray nozzle and allowing fuel to be injected into an engine cylinder (not shown). The plunger is acted upon by a rocker 70 which in turn follows cam 68 through an injection sequence thereby pressurizing the fuel during the injection sequence of operation.

The camshaft has a plurality of specially designed cam lobes to drive the EUI plungers. Ideally the camshaft has one cam lobe for each EUI. Each cam lobe has four sections. The first is a base circle section 21 for fuel metering process. The second is a rising section 23 for pressurizing fuel captured in the accumulative chamber. The third is a zero velocity section 25 when a plunger reaches its maximum lift. The third section should be long enough to cover all possible injection timing sequences. The fourth section is a falling section 27 which should be overlapped with a rising section of another cam lobe for recovering energy of remaining pressurized fuel in the accumulation chamber.

Turning now back to FIG. 1, the fuel system 72 is comprised of a fuel storage area depicted as a fuel tank 74 having a low pressure fuel passage 76 leading to a low pressure fuel pump 78. The low pressure fuel pump may be hydraulic or electric or of any sort which is able to keep output pressure at about 10 bar. A pressure regulator 80 is disposed on the fuel line 76 and is electrically connected to the ECM 81 to send and receive information to and from the ECM. The pressure regulator is applied at the output of the fuel delivery pump. Fuel pressure is feedback adjusted by the ECM. The fuel pressure regulator insures that the fuel pressure from the low pressure fuel pump is modulated and kept within a range of about 10 bar. A fuel pressure sensor 86 works in conjunction with the fuel pressure regulator to keep the output pressure of the fuel delivery pump at about 10 bar within the now constant fuel pressure passage 84. Fuel pressure passage 84 is in fluid communication with the metering orifice 26 of the injector to allow fuel to travel from the fuel tank to the injector and thereby be injected in the engine. Because the ECM controls the regulator based upon input from the sensor 86, only the precise amount of fuel needed by the injector is supplied to the accumulation chamber. Thus, it can be understood that there is no need to provide a spill passage to the accumulation chamber, as there is no excess of fuel. Thus, each injection event is a controlled, precise event that corresponds exactly with the engine performance and fuel requirements.

In an overview of the operation of the Electronic Controlled Fuel Injection System of the Present Invention, cam 68 rotates to a base circle section. The fuel cumulative chamber 28 begins to be short-circuited to the fuel supply port when the plunger is approaching its highest point. Under an ECM defined supply pressure, fresh fuel is fed into the fuel cumulative chamber through the metering 24. The amount of fuel fed into the fuel cumulative chamber is determined by the fuel supply pressure which is calibrated by a two-dimensional map, $P_S$=F (engine speed load), which is contained in the software of the ECM. The cumulative chamber is then filled and the cam begins to face the rising section and drives the plunger downward via operation of the rocker arm engaging the follower 20. The begin of pressurization point (BOP) is defined by the amount of fuel in the cumulative chamber. The pressurizing process ends when the maximum lift section of the camshaft has been reached. The steady high state pressure will be kept in the cumulative chamber until fuel injection actually begins. It has been determined that the fuel pressure level at the end of the fuel pressure rising period depends upon the begin of pressurization point. It follows therefore that the earlier the begin of pressurization point is defined, the a higher the fuel pressure.

The pressure in the cumulative chamber or fuel injection pressure is directly related to fuel feeding pressure and is independent of engine speed and load. By means of this system, it is anticipated that there are more freedoms to map fuel injection pressures and optimize engine performance and emission perimeters than was possible in the prior art. It will be further appreciated that all fuel volumes exposed to high pressure are in the cumulative chamber within the injector body and the maximum fuel injection pressure possible is comparable to the level of an electronic unit injector system.

In the fuel injection phase, the cam is in the maximum lift section and the plunger is kept stationary. The solenoid is activated by the ECM at calibrated timing to connect the nozzle chamber and the fuel cumulative chamber. The pressure in the needle chamber rises rapidly to lift the needle and start fuel injection. The injection pressure will be reduced gradually due to fuel injection. The allowed maximum fuel pressure drop is determined by the designed volume of the cumulative chamber which is a tradeoff of injector size. To this end, it is expected that the volume of the cumulative chamber is 20 to 60 times of maximum fuel volume/cycle of the needle chamber and is optimized based on a tradeoff of injector compactness, maximum injector pressure and maximum injection pressure drop.

During the pressure energy release phase, the cam begins its falling section. The plunger moves upward to push the cam load in the direction of its rotation through the expansion of the remaining pressurized fuel in the cumulative chamber. Since part of the energy consumed to pressurize fuel is recovered during this period, the total power consumption of the new injection system is less than that in conventional fuel injection systems. The end point of pressurizing and the begin point of pressure release are defined by smooth curves of the cam lobe. Therefore, there is much less abrupt mechanical impact on the camshaft and drive train. Moreover, it is now possible to adapt a common rail fuel system to a multi-cylindered internal combustion engine and eliminate the drawbacks of common rail fuel systems. Among these drawbacks are that of providing sufficient pressure in the fuel line to supply the injectors with enough fuel to satisfy engine needs.

Figure 4:
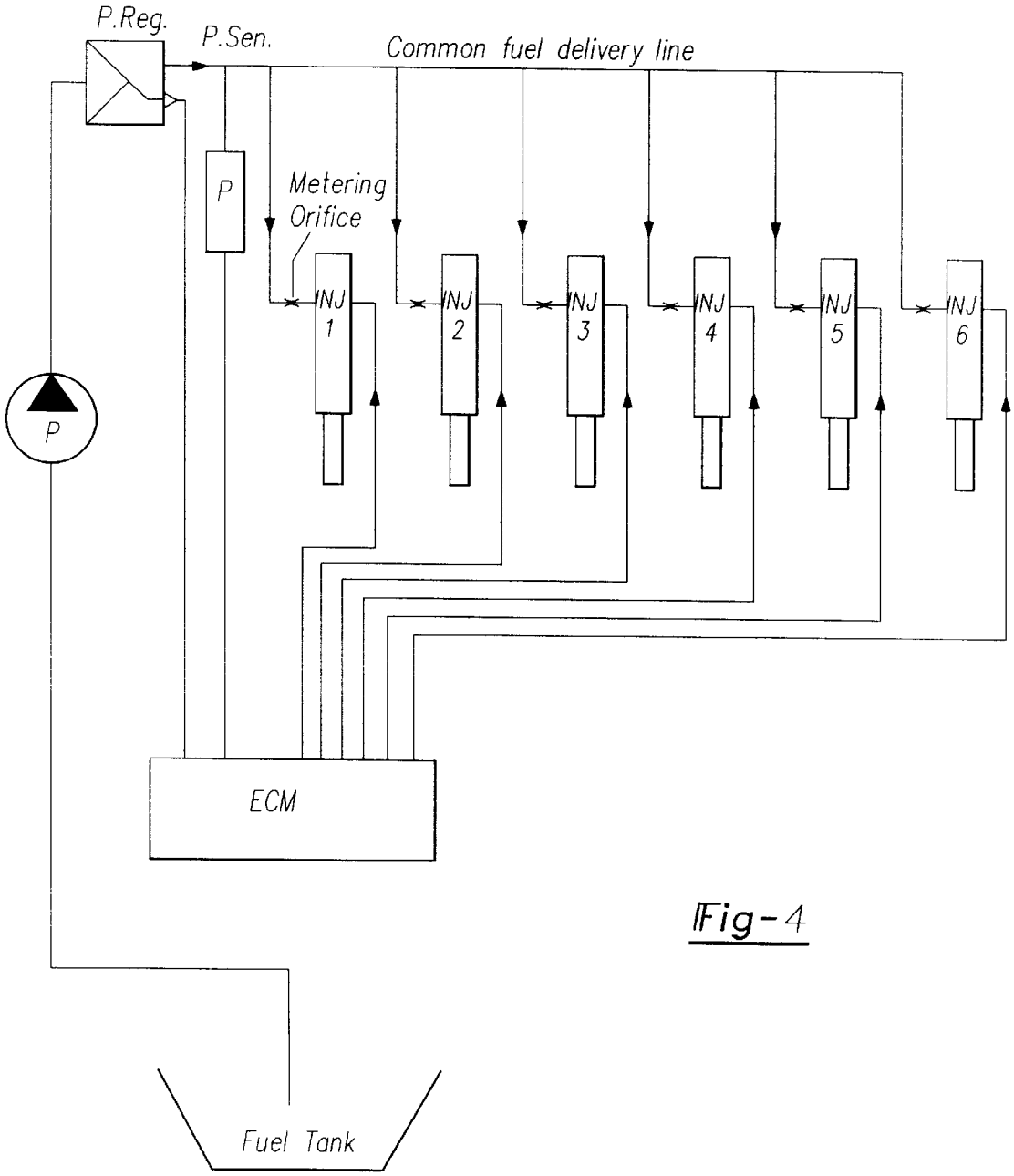
FIG. 4 is a schematic of a fuel injection system of the present invention utilizing a plurality of EUI's as depicted in FIG. 1.

FIG. 4 shows such a common rail fuel system. Indeed, it will become apparent to one of ordinary skill in the art that FIG. 1 is merely a detailed view of one EUI of the system of FIG. 4.

While the injection has been described with reference to structures disclosed herein, it is not confined to the specific details as set forth since it is apparent that many modifications and changes can be made by those skilled in the art without departing from the scope or spirit of the invention. The application is intended to cover such modifications or changes as may come within the improvements or scope of the following appended claims.

I claim:

1. A fuel injection system, comprising a low pressure fuel delivery pump with constant output in fluid communication with a low pressure fuel line; said fuel line connected to an electronic controlled fuel pressure regulator and fuel pressure sensor;

an electronic control module to monitor and adjust fuel pressure in said low pressure fuel line to a desired fuel delivery pressure and supply fuel to an injector at a feed-back controlled pressure; and at least one injector in fluid communication with a cylinder in an internal combustion engine; said injector having an injector body equipped with a fuel metering orifice to supply fuel from the fuel line to a fuel cumulative chamber within the injector, a reciprocating plunger within said injector; said plunger equipped with a plunger; said plunger passage opening at one end to said fuel cumulative chamber, and, upon reciprocation of the plunger within the injector, opening at its other end to said metering orifice; said injector further equipped with an electronically controlled solenoid control valve to operate a fuel needle within said injector to inflict fuel into said engine cylinder; and a camshaft at least one cam lobe to drive said injector plungers; said cam lobe having a base circle section to meter fuel for injection; a rising section for pressurizing fuel in the cumulative chamber; a zero velocity section of sufficient length to accommodate a variety of fuel injection timing sequences, and a falling section; said camshaft interactive with a rocker arm to drive said plunger and inject fuel into said engine cylinder.

2. The fuel injection system of claim 1, wherein said low pressure fuel delivery pump keeps the fuel delivered through the fuel line at a constant pressure of 10 to 20 bar.

3. The fuel injection system of claim 1, wherein said fuel metering orifice is of larger diameter than said low pressure fuel passage.

4. The fuel injection system of claim 1, wherein said low pressure fuel delivery passage is in communication with said metering orifice only when said plunger is in a fully returned position.

5. The fuel delivery system of claim 1, wherein said cumulation chamber is 10 to 20 times the maximum fuel volume/cycle of said needle chamber.

6. The fuel delivery system of claim 1, wherein said slow response solenoid is responsive to a pulse width modulated drive.

7. The fuel delivery system of claim 6, wherein said solenoid includes a poppet valve moveable within an armature chamber; said valve stem equipped with a fuel passage there through such that fuel is poured from the accumulation chamber through the stem passage and into the needle chamber only when the solenoid is activated.

* * * * *